US006205986B1

(12) United States Patent
Nojima et al.

(10) Patent No.: US 6,205,986 B1
(45) Date of Patent: Mar. 27, 2001

(54) INTAKE DEVICE FOR A V-TYPE ENGINE

(75) Inventors: Tetsuo Nojima, Hamamatsu; Yuji Sonoda, Shizuoka-ken, both of (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 0 days.

(21) Appl. No.: 09/453,272

(22) Filed: Dec. 2, 1999

(30) Foreign Application Priority Data

Dec. 18, 1998 (JP) ..... 10-360734

(51) Int. Cl.[7] ..... F02M 13/02
(52) U.S. Cl. ..... 123/579
(58) Field of Search ..... 123/579, 580, 123/583

(56) References Cited

U.S. PATENT DOCUMENTS 4,445,466 * 5/1984 Zaita et al. ..... 123/580
4,474,144 * 10/1984 Tanaka et al. ..... 123/579
4,517,940 * 5/1985 Koyanagi et al. ..... 123/580

FOREIGN PATENT DOCUMENTS 60-61468 4/1985 (JP) .

* cited by examiner

*Primary Examiner*—Marguerite McMahon
(74) *Attorney, Agent, or Firm*—Darby & Darby

(57) ABSTRACT

A V-type engine has front (first) and rear (second) cylinders being offset to sides opposite from each other. The front (first) and rear (second) carburetors are mounted in alignment with the centers of the front and rear cylinders, respectively. The body of the front carburetor and the body of the rear carburetor are coupled to each other by linkage plates arranged in parallel with the line that joins the center of the front carburetor and that of the rear carburetor. The throttle shaft of the front carburetor and the throttle shaft of the rear carburetor are laid out perpendicular to the linkage plates and coupled to each other by means of a coupling linkage which is in parallel with the linkage plates. A throttle cable is connected to the throttle shaft of the front carburetor.

4 Claims, 7 Drawing Sheets

INTAKE DEVICE FOR A V-TYPE ENGINE

BACKGROUND OF THE INVENTION (1) Field of the Invention

The present invention relates to an intake device for a V-type engine for synchronizing the carburetors of multiple cylinders of a V-type engine.

(2) Description of the Prior Art

In a typical V-type intake device for multi-cylinder engine for a motorcycle, each of the multiple cylinders has a separate carburetor, so there is the necessity of making synchronized control of the multiple carburetors. Japanese Utility Model Application Laid-Open Sho 60 No.61468 discloses an intake device in which the throttle shafts of the carburetors of the front and rear cylinders of a V-type engine are laid out coaxially on a line connected between the centers of the two carburetors (slightly inclined with respect to the line of center of the vehicle) and coupled to each other to thereby achieve synchronized control of multiple carburetors.

In an intake device configuration where the throttle shafts of multiple carburetors are merely connected as disclosed in Japanese Utility Model Application Laid-Open Sho 60 No.61468, there is a chance that the synchronization may be disordered if the carburetors are displaced relative to each other by vibrations and/or other reasons. To deal with this, as shown in FIG. 1, bodies 131 and 141 of carburetors 130 and 140 of the front and rear cylinders of a V-type engine may be connected to each other by means of linkage plates 150 and 150 so as to achieve an improved synchronized control of the two carburetors 130 and 140.

In this case, linkage plates 150 and 150 are arranged parallel to the vehicle's center line CL (perpendicular to the crankshaft) and attached to carburetors 130 and 140 by fasteners 159, 159, . . . , on both transverse sides of them. Since front and rear carburetors 130 and 140 are offset to opposite sides from each other, the attachment should be done with interposing spacers 158 and 158, . . . . Throttle shafts 136 and 146 of carburetors 130 and 140 are positioned perpendicular to the vehicle's center line CL and are coupled by a coupling linkage 160 which is parallel to linkage plates 150.

Thus, in the above intake device, the transversal distance between linkage plates 150 and 150 is large, increasing the weight and raising the cost. Further, since the transversal distance between linkage plates 150 and 150 is large, large overhangs of throttle shafts 136 and 146 (large projections of the shafts from bodies 131 and 141) need to be formed in order to couple throttle shafts 136 and 146 by means of coupling linkage 160. As a result, this configuration may cause increasing of the friction, being likely to be affected by dimensional errors and being low in its operativity.

SUMMARY OF THE INVENTION

It is therefore an object of the present invention to provide an intake device for a V-type engine in which the carburetors of multiple cylinders can be precisely synchronized. In order to achieve the above object, the present invention is configured as follows:

In accordance with the first aspect of the present invention, an intake device for a V-type engine having first and second cylinders being offset to the sides opposite to each other, wherein first and second carburetors are mounted in alignment with the centers of the first and second cylinders, respectively, and the throttle shafts of the first and second carburetors are coupled to each other, is characterized in that the body of the first carburetor and the body of the second carburetor are coupled by linkage plates arranged in parallel with the line that joins the center of the first carburetor and that of the second carburetor, and the throttle shaft of the first carburetor and the throttle shaft of the second carburetor are laid out perpendicular to the linkage plates and coupled to each other by means of a coupling linkage which is in parallel with the linkage plates.

In accordance with the second aspect of the present invention, the intake device for a V-type engine having the above first feature is characterized in that a throttle cable is connected to one of the throttle shafts and a cable support for supporting the throttle cable is formed in the linkage plate.

In accordance with the third and fourth aspects of the present invention, the intake device for a V-type engine having the above first or second feature is characterized in that the first and second carburetors have their intake channels inclined along respective V-bank sides, and the float chamber of the first carburetor and the float chamber of the second carburetor are provided on the V-bank sides.

In accordance with the first feature of the present invention, since the relative displacement of the first and second carburetors can be reduced by means of the linkage plates while at the same time increasing the transversal distance due to the attachment of the linkage plates and the increase in the overhangs of the throttle shafts for attachment of the coupling linkage can be suppressed. Accordingly, it is possible to precisely synchronize the first and second carburetors without degrading the operativity and durability of the carburetors and throttle. It is also possible to suppress increase of the attachment space, weight and cost, which would occur if the intake device was bulky.

In accordance with the second feature of the present invention, it is possible to couple the carburetor's bodies with each other by the linkage plates and the throttle cable can be supported simply.

In accordance with the third and fourth features of the present invention, it is possible to set the float chambers at lower positions.

DESCRIPTION OF THE PREFERRED EMBODIMENTS

Figure 1:
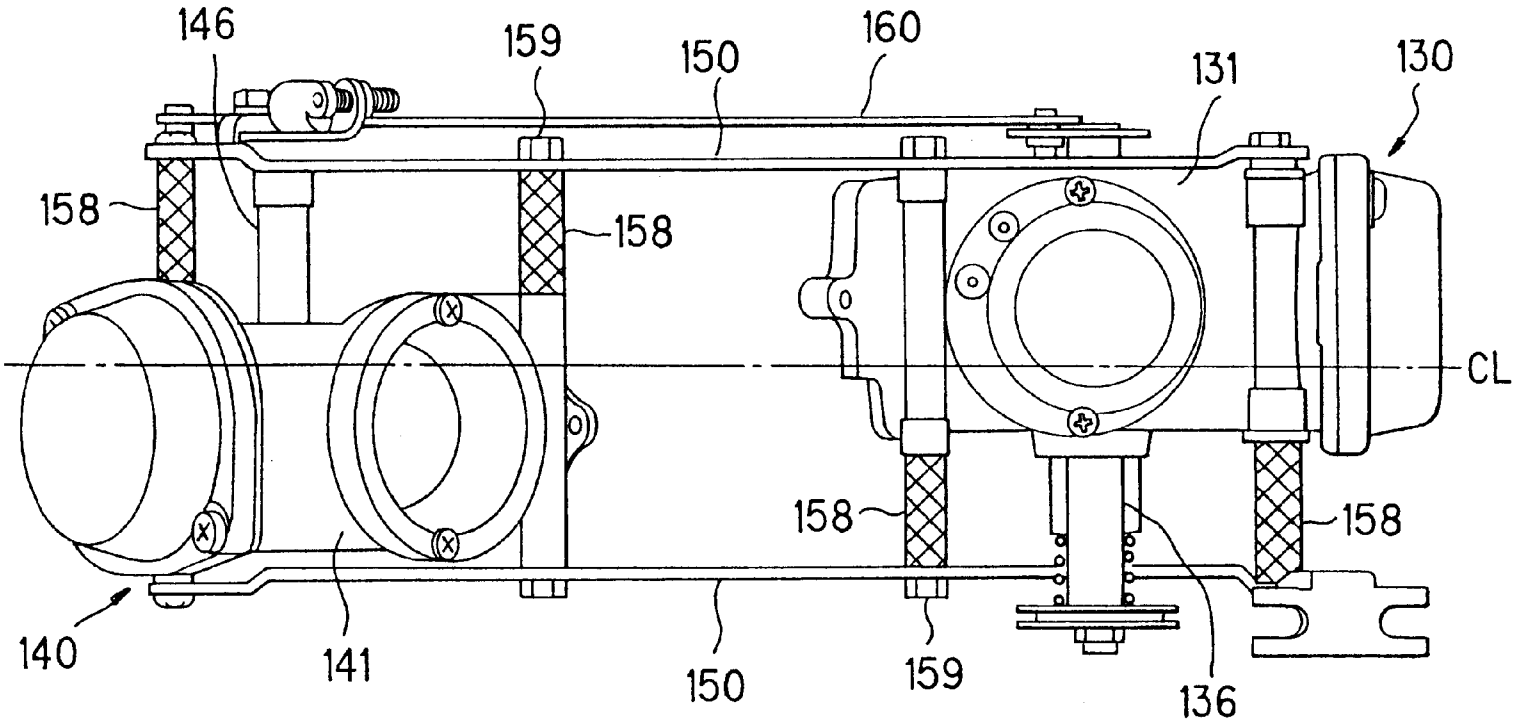
FIG. 1 PRIOR ART
FIG. 1 is a plan view showing an example of carburetor linkage structure.
Figure 2:
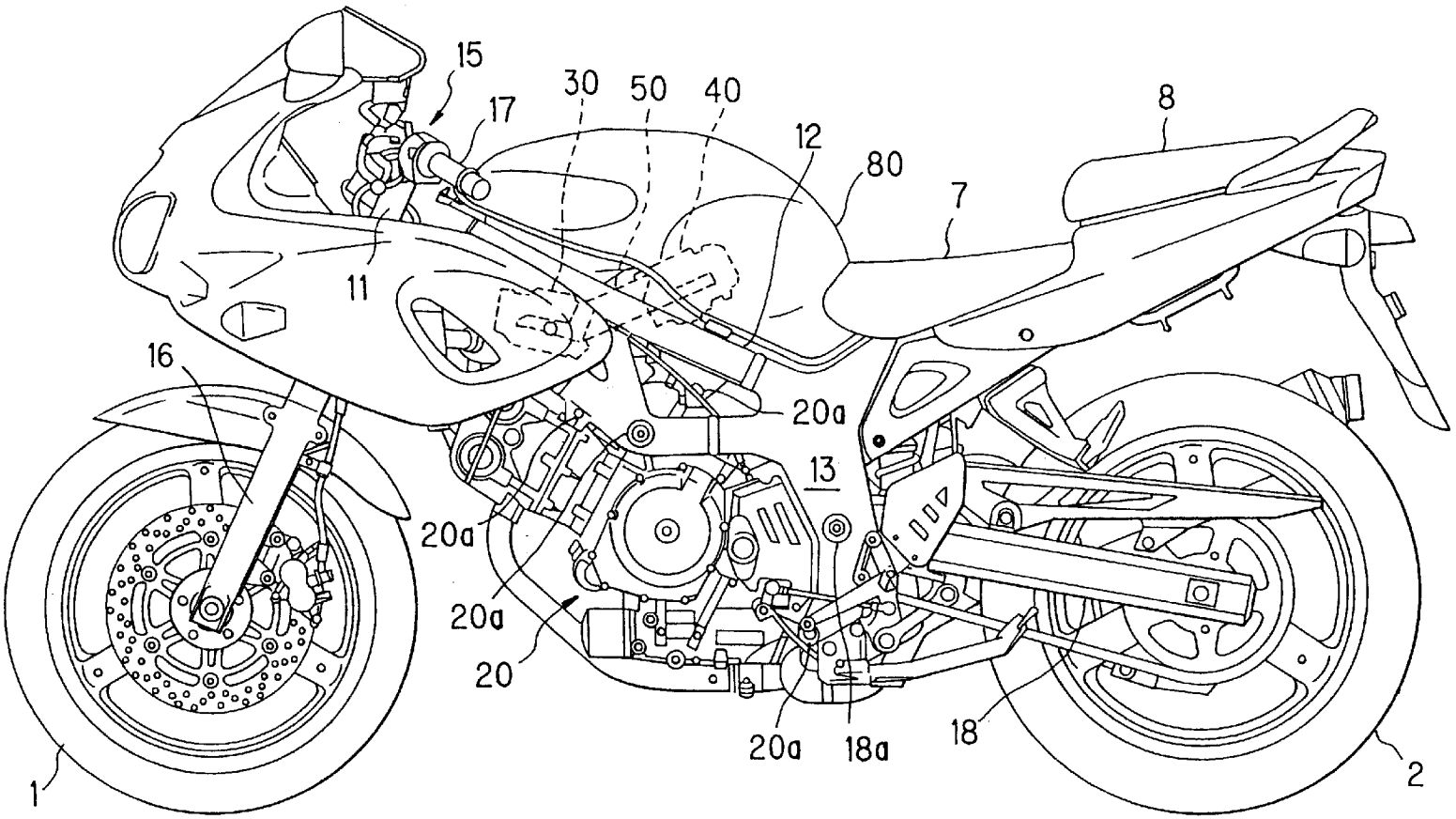
FIG. 2 is a left-side view showing a motorcycle to which an intake device of a V-type engine in accordance with the embodiment of the present invention is applied.
Figure 3:
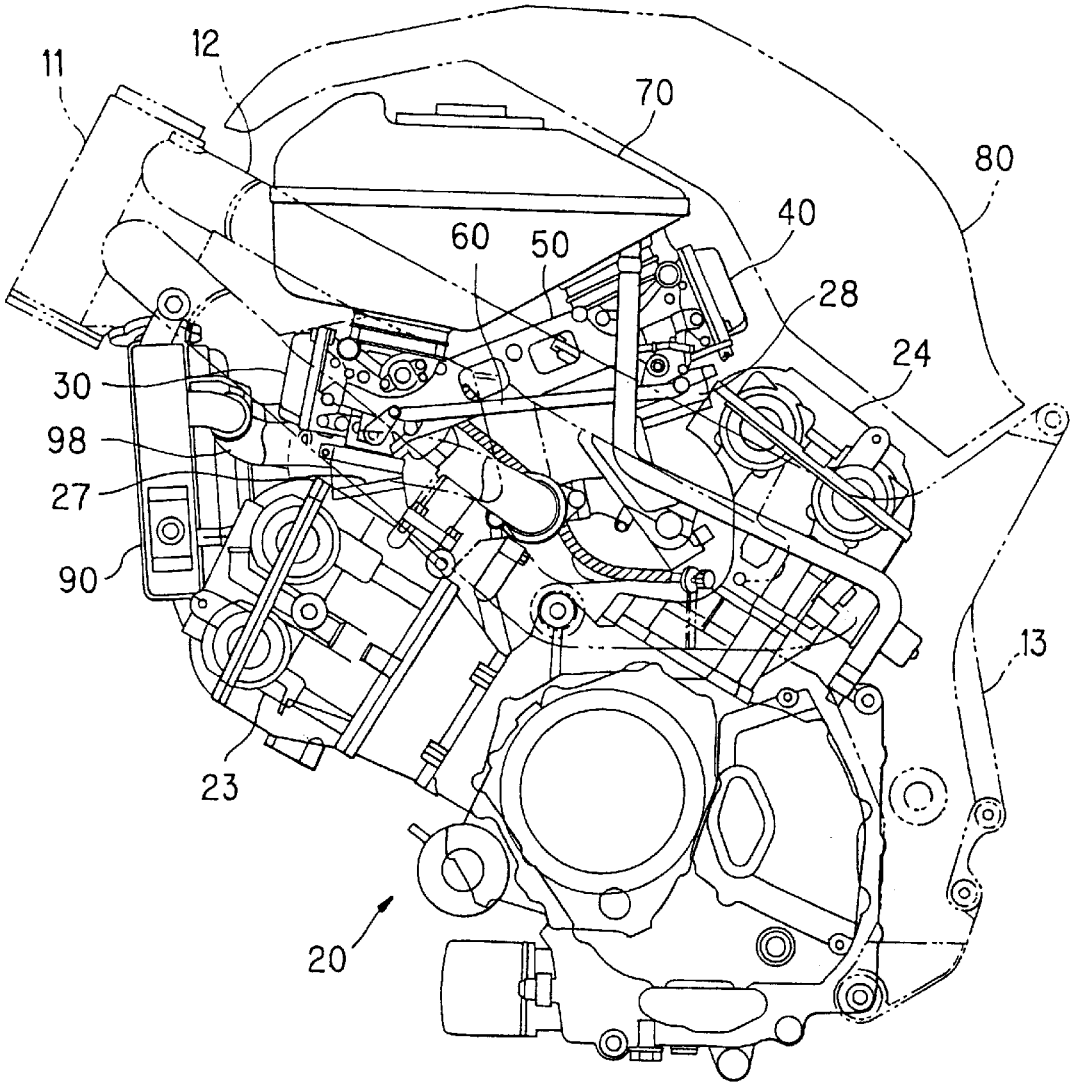
FIG. 3 is a left-side view showing the intake device in FIG. 2.
Figure 4:
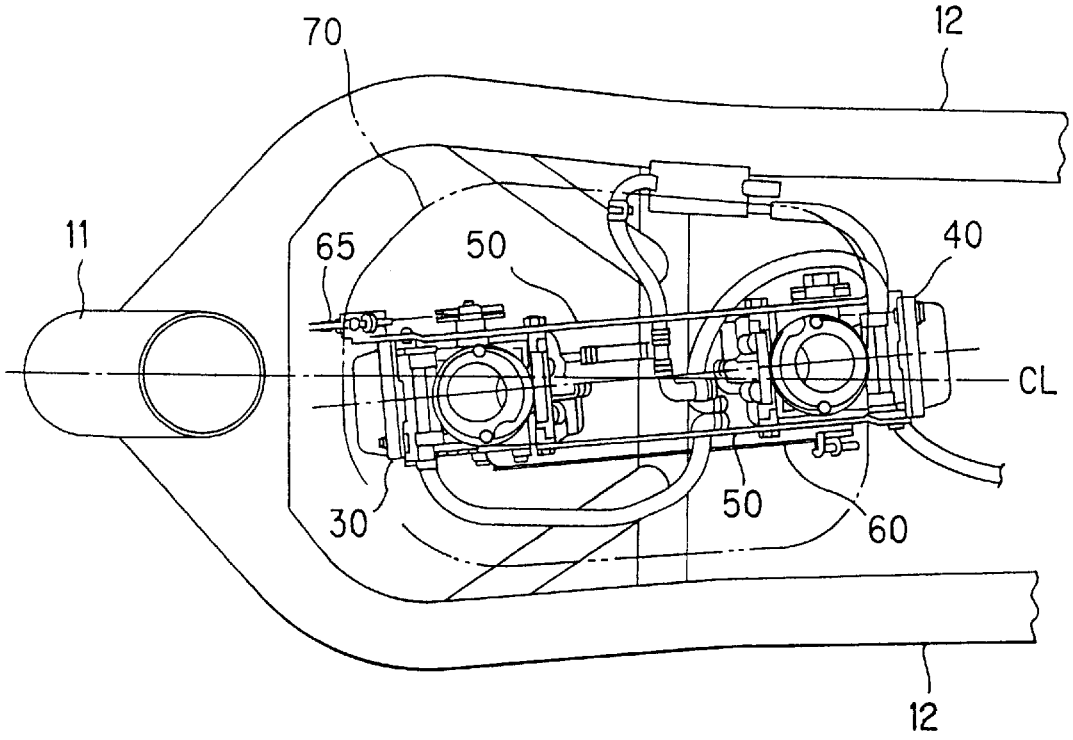
FIG. 4 is a plan view of the intake device of FIG. 3.
Figure 5:
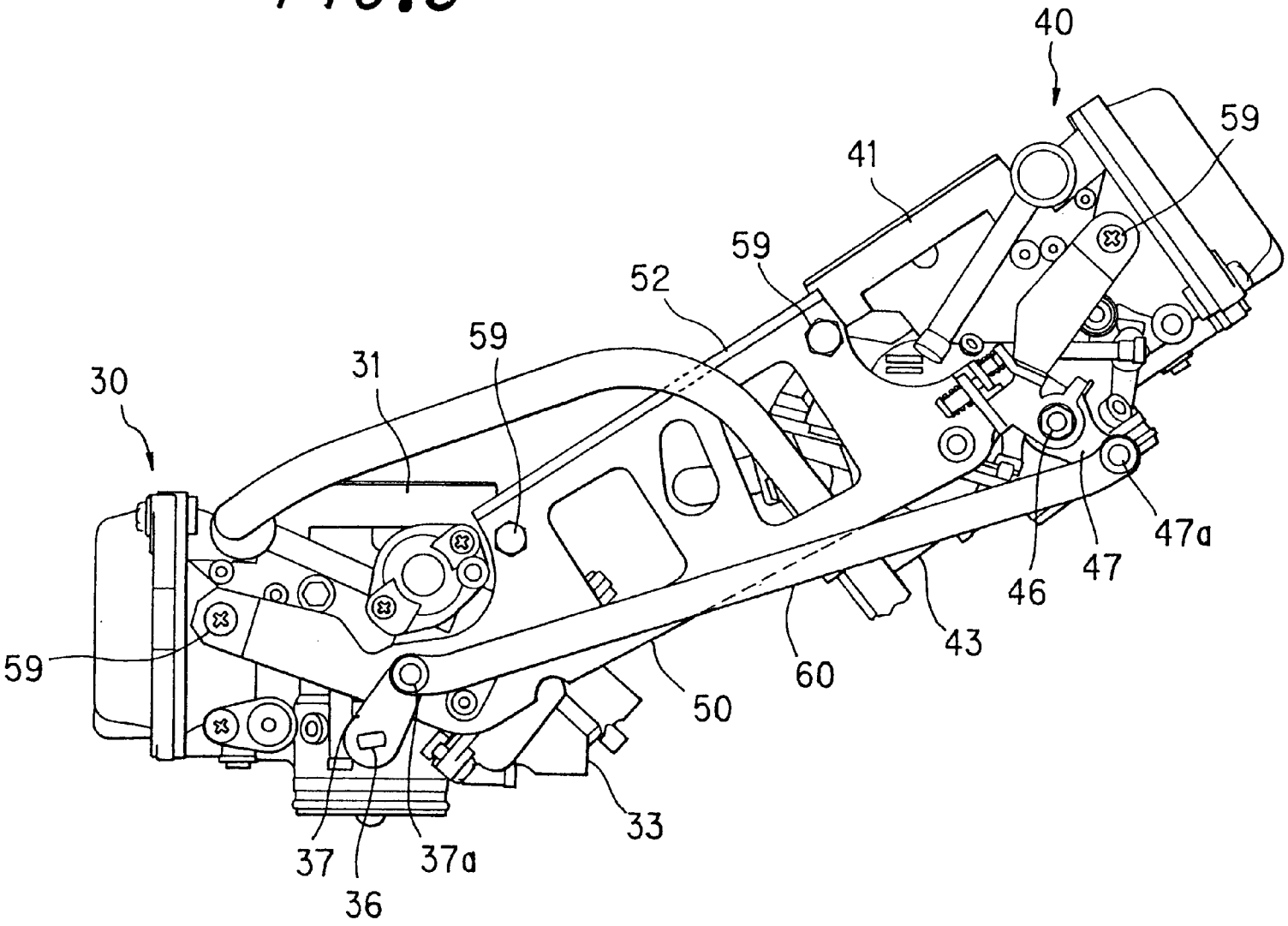
FIG. 5 is a left-side view showing a carburetor linkage structure in FIG. 3.
Figure 6:
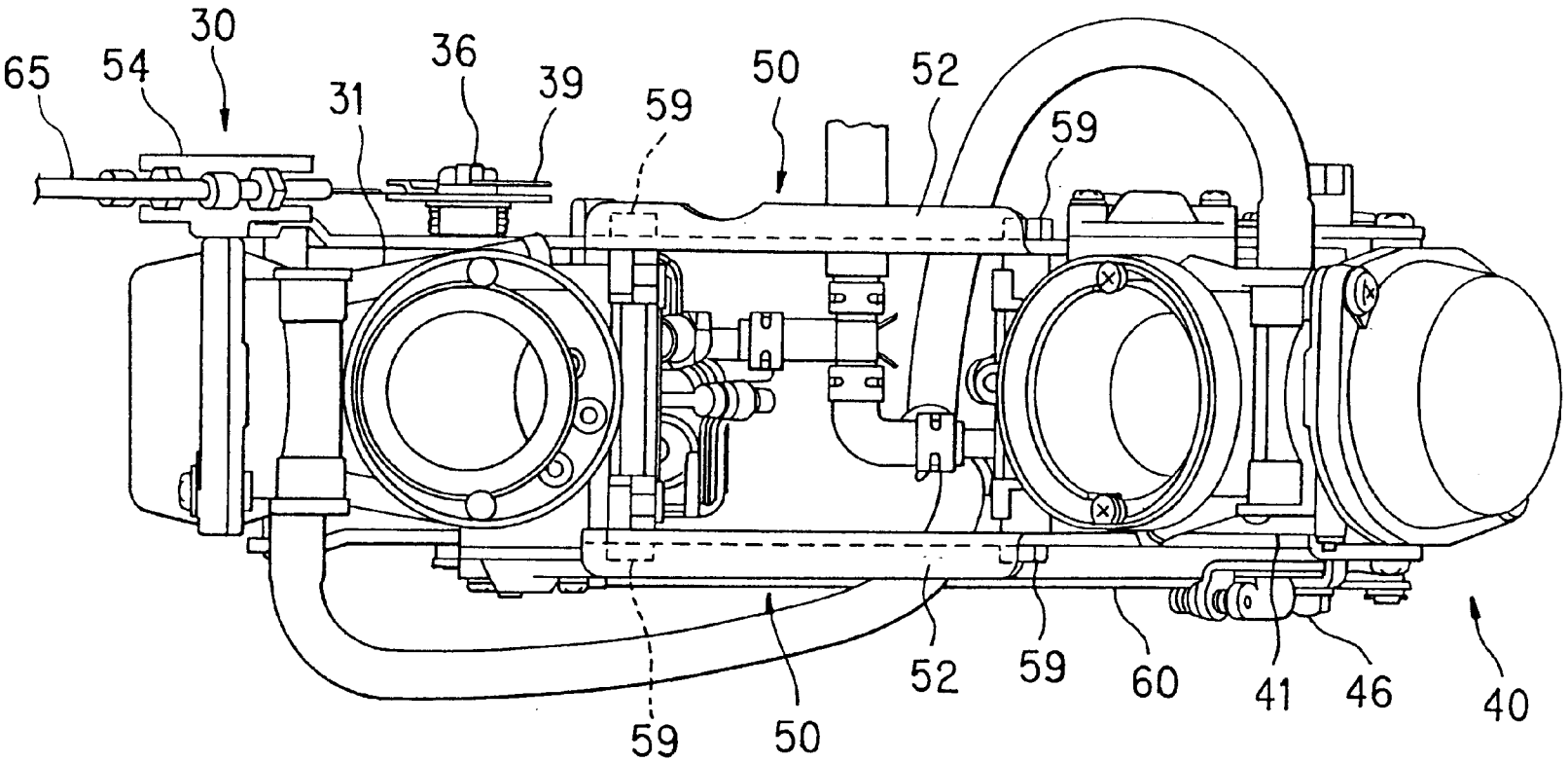
FIG. 6 is a plan view showing the carburetor linkage structure shown In FIG. 5.
Figure 7:
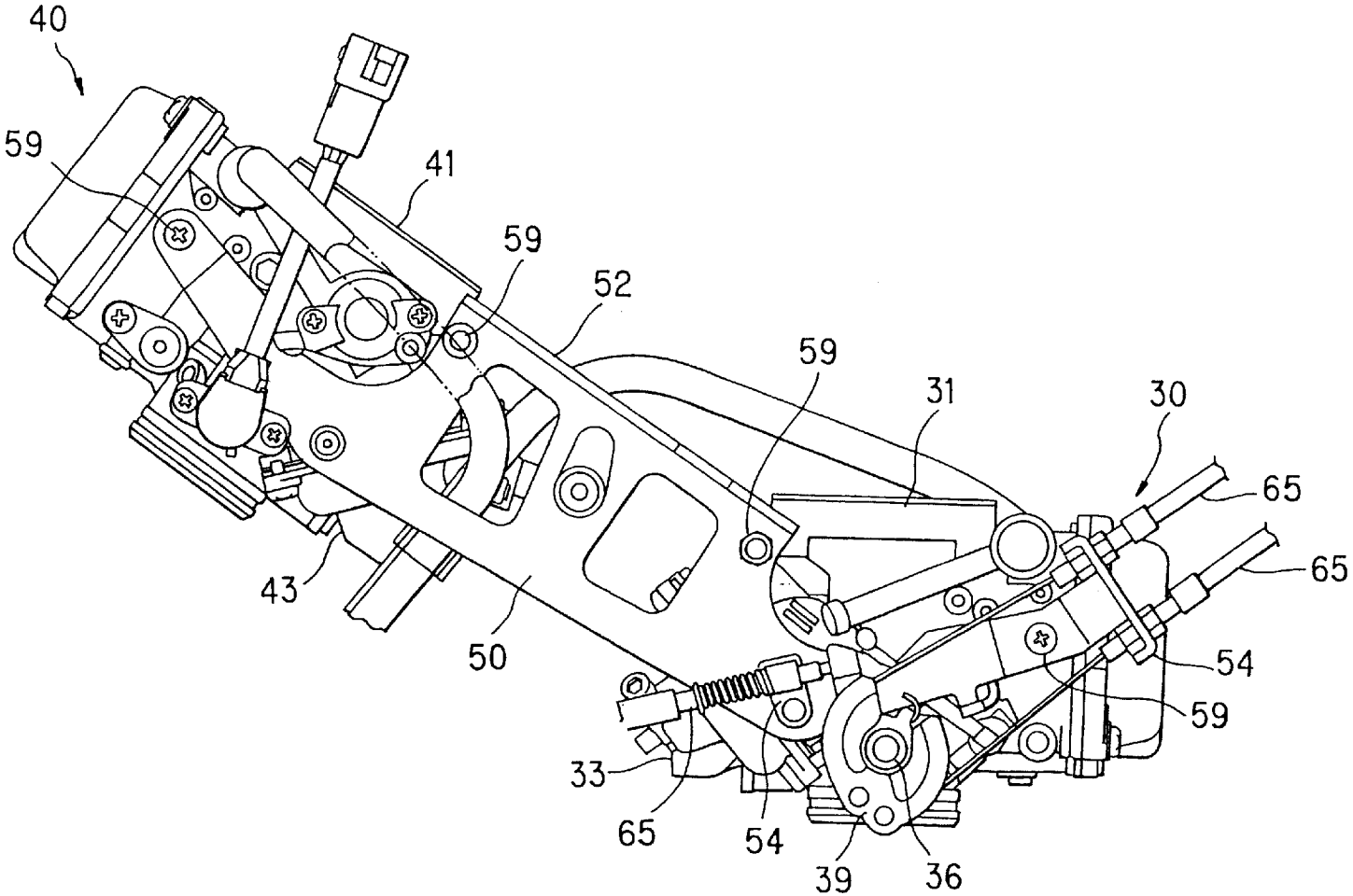
FIG. 7 is a right-side view showing the carburetor linkage structure shown in FIG. 5.

The embodiment of the present invention will hereinafter be described with reference to the accompanying drawings. FIG. 2 is a left-side view showing a motorcycle to which an intake device of a V-type engine in accordance with the embodiment of the present invention is applied. FIG. 3 is a left-side view showing the intake device in FIG. 2. FIG. 4 is its plan view. FIG. 5 is a left-side view showing a carburetor linkage structure in FIG. 3. FIG. 6 is its plan view. FIG. 7 is its right-side view.

The motorcycle to which the intake device for a V-type engine in accordance with the embodiment of the present invention is applied has a backbone type motorcycle frame as shown in FIG. 2. The motorcycle frame is made up of a head pipe 11 at the front end, a truss frame (side rails) 12 that is bifurcated from head pipe 11 downwards and rearwards on both sides, a body frame 13 that is projected approximately downwards from the rear of truss frame 12, and the like.

A steering device 15 is supported by head pipe 11 of the motorcycle frame so as to be turned left and right. Below steering device 15, a front wheel 1 is rotatably supported by front forks 16 while handlebars 17 are arranged in the upper part of steering device 15. A swing arm 18 is jointed below and in the rear of body frame 13 via a pivot 18*a* so that it can move up and down about the pivot. A rear wheel 2 is rotatably supported at the rear side of swing arm 18 so that the wheel can be driven by an aftermentioned engine 20. Provided in the upper part on the rear side of body frame 13 are seat rails (not shown) extending to the rear while front and rear seats 7 and 8 are placed on the seat rails.

As shown in FIG. 3, a four stroke V-type two cylinder engine 20 is transversally mounted in front of body frame 13, being supported by truss frame 12 and body frame 13 via support bolts 20*a*, 20*a* . . . . Engine 20 has two cylinders, i.e., front cylinder 23 and rear cylinder 24 forming a V-bank angle of about 90 degrees. Front cylinder 23 is offset to the left while rear cylinder 24 is offset to the right with respect to the center of engine 20 (or the vehicle's center). In the state of the engine being mounted in the motorcycle, front cylinder 23 is largely inclined forward (inclined about 60 degrees forwards) and positioned below truss frame 12 while rear cylinder 24 is relatively closer to the vertical (inclined about 30 degrees rearwards) and arranged between left and right parts of truss frame 12.

A front carburetor 30 (the first carburetor) is attached to the upper side (V-bank side) of front cylinder 23 via an intake pipe 27 while a rear carburetor 40 (the second carburetor) is attached to the upper front side (V-bank side) of rear cylinder 24 via an intake pipe 28. Front carburetor 30 and rear carburetor 40 are aligned with the centers of front cylinder 23 and rear cylinder 24, respectively. Therefore, as shown in FIG. 4, front and rear carburetors 30, 40 are offset to the left and the right, respectively.

As shown in FIGS. 5 through 7, linkage plates 50 and 50 are fixed on both sides, right and left, of bodies 31 and 41 of front and rear carburetors 30 and 40, by means of fasteners 59, 59, such as bolts, nuts, etc., so that bodies 31 and 41 of front and rear carburetors 30 and 40 are coupled to each other by means of linkage plates 50 and 50. Here, linkage plates 50, 50 are, as a whole, of a flat plate with reinforcing flanges 52, 52, etc., for increasing rigidity. Linkage plates 50, 50 are arranged in parallel to the line joining the center of front carburetor 30 and that of rear carburetor 40. That is, as shown in FIG. 4, linkage plates 50, 50 are arranged somewhat inclined with respect to the vehicle's center line CL due to left and right offsets of front and rear carburetors 30 and 40. Therefore, the transverse distance between left and right linkage plates 50 and 50 is shortened so that it is possible to suppress increase of the attachment space, the weight and the cost, which would occur if the intake device was bulky.

As shown in FIG. 3, the axial line of the intake channel of front carburetor 30 is oriented upward or set approximately vertically (slightly inclined rearwards) while the axial line of the intake channel of rear carburetor 40 is oriented forward and upward. As shown in FIGS. 5 and 7, a float chamber 33 of front carburetor 30 is arranged on the rear lower side (V-bank side) of body 31 while a float chamber 43 of rear carburetor 40 is arranged under body 41 (on the V-bank side). In this way, float chambers 33 and 43 of carburetors 30 and 40 are positioned as low as possible with respect to the intake channels of bodies 31 and 41. As shown in FIG. 3, front carburetor 30 is arranged above truss frame 12 and rear carburetor 40 is arranged between the left and right sides of truss frame 12.

As shown in FIGS. 5 and 6, throttle shafts 36 and 46 of front and rear carburetors 30 and 40 are arranged perpendicularly to linkage plates 50 and 50. The left ends of throttle shafts 36 and 46 are projected leftwards from left linkage plate 50 so that coupling levers 37 and 47 are fixed to the left ends of throttle shafts 36 and 46 so as to be projected perpendicular to throttle shafts 36 and 46. A coupling linkage 60 is arranged in parallel with linkage plate 50 and attached to the distal ends of coupling levers 37 and 47 via rotary pins 37*a* and 47*a* so that throttle shafts 36 and 46 can be controlled so as to be linked with each other. Here, since the transversal distance between left and right linkage plates 50 and 50 is shortened, the overhangs (projected amounts from bodies 31 and 41) of throttle shafts 36 and 46 for attachment of coupling linkage 60 can be reduced so that it is possible to improve the operativity and durability, which would be degraded if the overhangs of throttle levers 36 and 47 were large.

As shown in FIGS. 6 and 7, the right end of throttle shaft 36 of front carburetor 30 is projected rightward from right side linkage plate 50, and the throttle shaft 36 has a throttle lever 39 fixed at the right end thereof. Connected to throttle lever 39 is a throttle cable 65, which is supported by a cable support 54 integrally formed with linkage plate 50. That is, linkage plate 50 couples bodies 31 and 41 of front and rear carburetors 30 and 40 to each other and supports throttle cable 65.

As shown in FIG. 3, an air cleaner 70 is arranged over front and rear carburetors 30 and 40. The bottom front of air cleaner 70 is formed approximately horizontally (slightly inclined forwards and upwards) so as to be approximately perpendicular to the axial line of the intake channel of front carburetor 30. The bottom rear is inclined rearwards and upwards so as to be approximately perpendicular to the axial line of the intake channel of rear carburetor 40. Connected to the front air outlet at the bottom front of air cleaner 70 is body 31 of front carburetor 30. Body 41 of rear carburetor 40 is connected to the rear air outlet at the bottom rear. Air inlet of air cleaner 70 is arranged on the top center of air cleaner 70. Accordingly, air cleaner 70 is configured with minimum height whilst still securing an adequate volume. A fuel tank 80 is mounted over truss frame 12, and covers the upper and sides and rear side of cleaner 70.

A radiator 90 is arranged under truss frame 12 and in front of engine 20. A cooling water inlet provided at the upper right portion of radiator 90 is connected to the cooling water outlet on the engine 20 side via an upper radiator hose 98 etc. The cooling water outlet at the lower left of radiator 90 is connected to the cooling water inlet on the engine 20 side via an unillustrated lower radiator hose etc. The upper radiator hose 98 is arranged on the left side of front carburetor 30 while the lower radiator hose is arranged on the right side of front cylinder 23. A reserve tank (not shown) is arranged on the right side of front carburetor 27 and on the left side (inner side) of the right part of truss frame 12. Because the transversal distance between linkage plates 50 and 50 of carburetors 30 and 40 is small, upper radiator hose 93, the reserve tank and the like can be laid out at the side of the assembly.

In an intake device thus configured, when throttle shaft 36 of front carburetor 30 is operated by throttle cable 65 via single throttle lever 39, throttle shaft 46 of rear carburetor 40 is also operated by way of coupling lever 37, coupling linkage 60 and coupling lever 47. Since bodies 31 and 41 of front and rear carburetors 30 and 40 are coupled to each other by means of rigid linkage plates 50, relative displacement of bodies 31 and 41 of front and rear carburetors 30 and 40 can be regulated. Accordingly, it is possible to precisely synchronize front and rear carburetors 30 and 40.

Now that the embodiment of the present invention has been described it should be noted that the present invention is not be limited to the above mode of the embodiment. For example, in the above embodiment, the throttle cable is connected to the throttle shaft of the front carburetor, but it may be connected to the throttle shaft of the rear carburetor. Alternatively, though the above embodiment is applied to a V-type two cylinder engine, the present invention can also be applied to a V-type four cylinder engine, etc.

In accordance with the first feature of the present invention, since the relative displacement of the first and second carburetors can be reduced by means of the linkage plates while at the same time increasing in the transversal distance due to the attachment of the linkage plates and the increase in the length of the throttle shafts for attachment of the coupling linkage can be suppressed. Accordingly, it is possible to precisely synchronize the first and second carburetors without degrading the operativity and durability of the carburetors and throttle. It is also possible to suppress increase of the attachment space, weight and cost, which would occur if the intake device was bulky.

In accordance with the second feature of the present invention, it is possible to couple the carburetor's bodies with each other by the linkage plates and the throttle cable can be supported simply. In accordance with the third and fourth features of the present invention, it is possible to set the float chambers at lower positions.

What is claimed is:

1. An intake device for a V-type engine having first and second cylinders being offset to the sides opposite to each other, wherein first and second carburetors are mounted in alignment with the centers of the first and second cylinders, respectively, and the throttle shafts of the first and second carburetors are coupled to each other, being characterized in that the body of the first carburetor and the body of the second carburetor are coupled by linkage plates arranged in parallel with the line that joins the center of the first carburetor and that of the second carburetor, and the throttle shaft of the first carburetor and the throttle shaft of the second carburetor are laid out perpendicular to the linkage plates and coupled to each other by means of a coupling linkage which is in parallel with the linkage plates.

2. The intake device for a V-type engine according to claim 1, wherein a throttle cable is connected to one of the throttle shafts and a cable support for supporting the throttle cable is formed in the linkage plate.

3. The intake device for a V-type engine according to claim 1, wherein the first and second carburetors have their intake channels inclined along respective V-bank sides, and the float chamber of the first carburetor and the float chamber of the second carburetor are provided on the V-bank sides.

4. The intake device for a V-type engine according to claim 2, wherein the first and second carburetors have their intake channels inclined along respective V-bank sides, and the float chamber of the first carburetor and the float chamber of the second carburetor are provided on the V-bank sides.

* * * * *

UNITED STATES PATENT AND TRADEMARK OFFICE

CERTIFICATE OF CORRECTION

PATENT NO. : 6,205,986 B1
DATED : March 27, 2001
INVENTOR(S) : Tetsuo Nojima; Yuji Sonoda It is certified that error appears in the above-identified patent and that said Letters Patent is hereby corrected as shown below:

Title page,
Item [75], Inventor, change "Snizuoka-Ken" to -- Iwata-Gun --.

Signed and Sealed this

Twenty-ninth Day of January, 2002

*Attest:*

*Attesting Officer*

JAMES E. ROGAN
*Director of the United States Patent and Trademark Office*